US012232600B2

(12) United States Patent
Williams et al.

(10) Patent No.: US 12,232,600 B2
(45) Date of Patent: Feb. 25, 2025

(54) WEARABLE ORNAMENT IMPLEMENTS

(71) Applicant: FiGPiN Collect Awesome, Inc., Irvine, CA (US)

(72) Inventors: Daniel Williams, Bothell, WA (US); Amado Batour, La Jolla, CA (US); Erik Haldi, Bothell, WA (US)

(73) Assignee: FiGPiN Collect Awesome, Inc., Irvine, CA (US)

( * ) Notice: Subject to any disclaimer, the term of this patent is extended or adjusted under 35 U.S.C. 154(b) by 188 days.

(21) Appl. No.: 17/994,344

(22) Filed: Nov. 27, 2022

(65) Prior Publication Data

US 2023/0086056 A1 Mar. 23, 2023

Related U.S. Application Data

(63) Continuation-in-part of application No. 29/583,506, filed on Nov. 6, 2016, now Pat. No. Des. 813,713, and a continuation-in-part of application No. 29/736,378, filed on May 29, 2020, now Pat. No. Des. 974,902, and a continuation-in-part of application No. 29/736,374, filed on May 29, 2020, now Pat. No. Des. 943,398, and a continuation-in-part of application (Continued)

(51) Int. Cl.

| | |
|---|---|
| ***A45F 5/00*** | (2006.01) |
| ***A45C 13/08*** | (2006.01) |
| ***A45F 5/02*** | (2006.01) |
| ***A63H 3/00*** | (2006.01) |
| ***A63H 3/50*** | (2006.01) |
| *A45C 13/30* | (2006.01) |

(52) U.S. Cl.

CPC ..... *A45F 5/00* (2013.01); *A45C 13/08* (2013.01); *A45F 5/02* (2013.01); *A63H 3/003* (2013.01); *A63H 3/50* (2013.01); *A45C 2013/306* (2013.01); *A45F 2005/006* (2013.01)

(58) Field of Classification Search

CPC ..... A45F 5/00; A45F 2005/006; A45F 5/02; A63H 3/003; A63H 3/50; A45C 13/08; A45C 2013/306

See application file for complete search history.

(56) References Cited

U.S. PATENT DOCUMENTS 3,630,048 A 12/1971 Masters
4,552,264 A 11/1985 Quarrell
(Continued)

*Primary Examiner* — Robert Sandy
*Assistant Examiner* — Rowland Do
(74) *Attorney, Agent, or Firm* — Puget Patent; Michael Gibbons

(57) ABSTRACT

A packaging arrangement for a wearable ornament, such as a pin-backed figurine that is supplied with a loop backer enabling the figurine to be coupled with a rope or chain, includes a post for display of the figurine using with the loop backer when not being worn. The figurine on the post may be snapped into a base, the base having a base top and base bottom that are separable from one another. A transparent cover encloses the figurine on the post atop the base, with a backing held in place behind the figurine in the packaging by retention tabs proximate to top corners of the transparent cover, by alignment ridges of the base top and by support posts inside the base bottom. The figurine may therefore be worn either through being pinned or on a rope or chain, or may be displayed either on just the post or on the post atop the base.

20 Claims, 4 Drawing Sheets

Related U.S. Application Data

No. 29/736,369, filed on May 29, 2020, now Pat. No. Des. 988,760, and a continuation-in-part of application No. 29/736,366, filed on May 29, 2020, now Pat. No. Des. 982,949, and a continuation-in-part of application No. 15/436,441, filed on Feb. 17, 2017, now Pat. No. 10,672,301, and a continuation-in-part of application No. 15/582,472, filed on Apr. 28, 2017, now abandoned, and a continuation of application No. 15/390,478, filed on Dec. 24, 2016, now abandoned, and a continuation-in-part of application No. 29/583,505, filed on Nov. 6, 2016, now Pat. No. Des. 814,335, and a continuation-in-part of application No. 29/570,329, filed on Jul. 7, 2016, now Pat. No. Des. 836,479, and a continuation-in-part of application No. 15/149,668, filed on May 9, 2016, now Pat. No. 10,681,967, and a continuation of application No. 16/891,013, filed on Jun. 2, 2020, now Pat. No. 11,533,983, and a continuation-in-part of application No. 29/736,380, filed on May 29, 2020, now Pat. No. Des. 974,903.

(56) References Cited

U.S. PATENT DOCUMENTS

| | | | | |
|---|---|---|---|---|
| 5,953,755 | A | 9/1999 | Barylski | |
| 6,047,833 | A | 4/2000 | Salomon | |
| 6,056,130 | A | 5/2000 | Ovadia | |
| 6,178,680 | B1 * | 1/2001 | Sloot | G09F 21/02 40/668 |
| 6,367,126 | B1 | 4/2002 | Rivkin | |
| 7,966,755 | B1 | 6/2011 | Reeves | |
| 8,114,100 | B2 | 2/2012 | Smith | |
| 2008/0223282 | A1 | 9/2008 | Scott | |
| 2012/0167353 | A1 | 7/2012 | Geller | |
| 2013/0019380 | A1 * | 1/2013 | Sitt | A42B 1/24 248/205.2 |
| 2016/0149386 | A1 | 5/2016 | Stechmann | |
| 2018/0310727 | A1 * | 11/2018 | Williams | A47F 3/145 |

* cited by examiner

WEARABLE ORNAMENT IMPLEMENTS

PRIORITY CLAIM

The present application is related to and/or claims the benefits of the earliest effective priority date and/or the earliest effective filing date of the below-referenced applications, each of which is hereby incorporated by reference in its entirety, to the extent such subject matter is not inconsistent herewith, as if fully set forth herein:

(1) this application constitutes a continuation of U.S. patent application Ser. No. 16/891,013, entitled WEARABLE ORNAMENT IMPLEMENTS, naming Daniel Williams, Amado Batour, and Erik Haldi as the inventors, filed Jun. 2, 2020, which is currently co-pending or is an application of which a currently co-pending application is entitled to the benefit of the filing date;

(2) this application constitutes a continuation-in-part of U.S. patent application Ser. No. 29/736,380, entitled BASE TOP, naming Daniel Williams, Amado Batour, and Erik Haldi as the inventors, filed May 29, 2020, which is currently co-pending or is an application of which a currently co-pending application is entitled to the benefit of the filing date;

(3) this application constitutes a continuation-in-part of U.S. patent application Ser. No. 29/736,378, entitled BASE BOTTOM, naming Daniel Williams, Amado Batour, and Erik Haldi as the inventors, filed May 29, 2020, which is currently co-pending or is an application of which a currently co-pending application is entitled to the benefit of the filing date;

(4) this application constitutes a continuation-in-part of U.S. patent application Ser. No. 29/736,374, entitled LOOP BACKER, naming Daniel Williams, Amado Batour, and Erik Haldi as the inventors, filed May 29, 2020, which is currently co-pending or is an application of which a currently co-pending application is entitled to the benefit of the filing date;

(5) this application constitutes a continuation-in-part of U.S. patent application Ser. No. 29/736,369, entitled SHORT POST, naming Daniel Williams, Amado Batour, and Erik Haldi as the inventors, filed May 29, 2020, which is currently co-pending or is an application of which a currently co-pending application is entitled to the benefit of the filing date;

(6) this application constitutes a continuation-in-part of U.S. patent application Ser. No. 29/736,366, entitled TALL POST, naming Daniel Williams, Amado Batour, and Erik Haldi as the inventors, filed May 29, 2020, which is currently co-pending or is an application of which a currently co-pending application is entitled to the benefit of the filing date;

(7) this application constitutes a non-provisional of U.S. Provisional Patent Application No. 63/011,931, entitled WEARABLE ORNAMENT IMPLEMENTS, naming Daniel Williams, Amado Batour, and Erik Haldi as the inventors, filed Apr. 17, 2020, which is currently co-pending or is an application of which a currently application is entitled to the benefit of the filing date;

(8) this application constitutes a continuation-in-part of U.S. patent application Ser. No. 15/436,441, entitled SYSTEMS AND METHODS FOR CONVERTING WEARABLE ORNAMENTS TO DISPLAYS, naming Daniel Williams, Amado Batour, and Erik Haldi as the inventors, filed Feb. 17, 2017, which is currently co-pending or is an application of which a currently co-pending application is entitled to the benefit of the filing date;

(9) this application constitutes a continuation-in-part of U.S. patent application Ser. No. 15/582,472, entitled DISPLAY CASE, naming Daniel Williams, Amado Batour, and Erik Haldi as the inventors, filed Apr. 28, 2017, which is currently co-pending or is an application of which a currently co-pending application is entitled to the benefit of the filing date;

(10) this application constitutes a continuation-in-part of U.S. patent application Ser. No. 15/390,478, entitled WEARABLE ORNAMENT DISPLAY, naming Daniel Williams, Amado Batour, and Erik Haldi as the inventors, filed Dec. 24, 2016, which is currently co-pending or is an application of which a currently co-pending application is entitled to the benefit of the filing date;

(11) this application constitutes a continuation-in-part of U.S. patent application Ser. No. 29/583,506, entitled WEARABLE ORNAMENT DISPLAY, naming Daniel Williams, Amado Batour, and Erik Haldi as the inventors, filed Nov. 6, 2016, and issuing on Mar. 27, 2018 as U.S. Design Pat. No. D813,713, which is currently co-pending or is an application of which a currently co-pending application is entitled to the benefit of the filing date;

(12) this application constitutes a continuation-in-part of U.S. patent application Ser. No. 29/583,505, entitled WEARABLE ORNAMENT DISPLAY, naming Daniel Williams, Amado Batour, and Erik Haldi as the inventors, filed Nov. 6, 2016, and issuing on Apr. 3, 2018 as U.S. Design Pat. No. D814,335, which is currently co-pending or is an application of which a currently co-pending application is entitled to the benefit of the filing date;

(13) this application constitutes a continuation-in-part of U.S. patent application Ser. No. 29/570,329, entitled WEARABLE ORNAMENT DISPLAY, naming Daniel Williams, Amado Batour, and Erik Haldi as the inventors, filed Jul. 7, 2016, and issuing on Dec. 25, 2018 as U.S. Design Pat. No. D836,479, which is currently co-pending or is an application of which a currently co-pending application is entitled to the benefit of the filing date; and

(14) this application constitutes a continuation-in-part of U.S. patent application Ser. No. 15/149,668, entitled SYSTEMS AND METHODS FOR CONVERTING WEARABLE ORNAMENTS TO DISPLAYS, naming Daniel Williams, Amado Batour, and Erik Haldi as the inventors, filed May 9, 2016, which is currently co-pending or is an application of which a currently co-pending application is entitled to the benefit of the filing date.

FIELD OF THE INVENTION

This invention relates generally to collectibles such as wearable ornaments (e.g. figurines), and, more specifically, to implements for such collectibles.

BACKGROUND OF THE INVENTION

Collectibles, such as wearable ornaments and figurines, may be displayed by a collector in several manners. Figurines, for example, can come in versions which may be worn by the collector. A collectible wearable figurine may have one or more pins extending from its back, enabling the figurine to be pressed into an article of clothing with the pins extending through the fabric so that the figurine is wearable by the collector. A pin backer may be provided in which the sharp points of the pins, subsequent to their piercing of the fabric, are enclosed by the backer so as to not injure the wearer or inadvertently pierce any other goods or materials.

Yet the collector may sometimes (or even always) wish to wear the figurine without piercing an article of clothing. Separately, when the figurine is not being worn, the collector may wish to display the figurine on a shelf, a table or in another location where the figurine is visible to its owner.

In some genres of the hobby of collectibles, the packaging of the collectible itself takes on additional relevance. To some collectors, the resale value of the collectible item is enhanced if the collectible is never removed from the packaging in which the collectible was packaged by the manufacturer of the collectible. But if the packaging is never opened, in order for the collectible to be visible and valuable the packaging itself and the manner in which the collectible is viewable through the packaging becomes important. Separately, the manner in which the collectible is viewable through the packaging may affect a prospective buyer's impression when the collectible is stock in its packaging on a store's shelf. Being able to see the collectible through the packaging is desirable, and the appearance of the collectible in an "action pose" inside the packaging is even more likely to trigger a sale of the item at the store.

Alternatively, some collectors may be comfortable removing the collectible item from the packaging, but may wish to retain and reuse some or all of the packaging in order to display the collectible item.

Accordingly, the packaging for a collectible item such as a figurine becomes more than a means of protecting goods during transportation to a distributor, or during display on a retailer's shelf, or while inside of a shipping box bound for an online purchaser of the collectible. Carefully-designed packaging becomes a part of the collectible's inherent value and can result in higher revenues for a manufacturer. In fact, since some or all of the packaging will likely be retained and reused by a purchaser, providing a durable packaging for a collectible which retains a pristine appearance for the post-sale use of the packaging is also important.

Accordingly, innovations in packaging of wearable ornaments such as figurines, as well as different implements for the wearing and display of such collectibles, are disclosed herein.

DESCRIPTION OF RELATED ART

U.S. Pat. No. 6,056,130 issued to Joseph Ovadia on May 2, 2000 discloses a unitarily molded display stand for displaying articles of jewelry. Ovadia does not specifically discuss embodiments permitting a collectible to be viewed through the packaging in which it is contained on a store shelf, nor does it discuss providing packaging elements which, subsequent to the collectible being removed from the packaging, enable the wearing of the collectible item.

U.S. Pat. No. 4,552,264 to Richard Quarrell et al. on Mar. 27, 1984 discloses a self-service jewelry container with a transparent cover. Quarrell does not disclose a transparent cover which secures to the base of the packaging in a manner that prevents the cover and base from sliding against one another during shipping, such sliding action potentially damaging the packaging.

U.S. Pat. No. 6,047,833 to Mark Salomon on Oct. 8, 1998 discloses a display package with base and transparent cover for display of a figurine. Similar to Quarrell, Salomon does not disclose a transparent cover which secures to the base of the packaging in a manner that prevents the cover and base from sliding against one another during shipping, such sliding action potentially damaging the packaging.

SUMMARY

The instant application discloses a loop backer for a figurine and a post to which the figurine can be coupled using the loop backer. The loop backer receives the sharp ends of the pins on the back of the figurine and frictionally retains them. Thus the loop backer may be used when the figurine is pinned to an article of clothing. The loop backer also has a rounded or oval channel through its handle, enabling a chain, rope or other tie to be passed through the channel. In this manner the figurine may be worn on a chain around a person's neck, or may be attached to a backpack, or used as a keychain, for example.

The post is an element of packaging, but may also be used separate from the packaging as a display stand for a figurine. When packaged, the pins of the figurine pass through pin channels through the post and are then inserted into the loop backer. The loop backer frictionally retains the pins, sandwiching the upright portion of the post between the back of the figurine and the face of the loop backer having the pin receptacles. The post has features which enable it to snap securely into the packaging base so that the figurine is not dislodged from the remainder of the packaging during shipment. The post also has a flat bottomed foot, enabling the post to rest upon a flat surface with the figurine attached. It is noted that the figurine itself is able to be entirely supported by the post when the post is rested on a surface, with no portion of the figurine coming into contact with that surface. The figurine is therefore displayed in a "flying" posture, which is an action pose that is aesthetically interesting to a viewer. This "flying" posture may further be provided through a slight angle of the post's upright portion from the perpendicular of the foot of the post, and/or through a slight curve from front to back of the post's upright portion. Non-standing poses other than flying are achievable as well. Additionally, the snap features of the post are subtly provided on either side of the foot of the post. The manufacturer therefore gets the benefit of secure packaging, while the visual appearance of the figurine and stand upon being displayed by the owner is not diminished by the snap features.

As discussed above, the post snaps securely into the packaging base, and the base itself has elements that augment the value and integrity of the packaging. The base has two portions, a base top and a base bottom. The foot of the post snaps into a recess within the upper face of the base top. The base top also has tabs on either side which mate with recesses in a transparent cover of the packaging to prevent the base and cover from sliding against one another in shipment, potentially scratching either or both articles. The base bottom may be de-coupled from the base top by the owner of the figurine. The base bottom, which may have a logo on its front face, can be rotated 180 degrees after being de-coupled and then the base bottom and base top may be re-coupled by snapping them together. The base can be used outside the packaging in conjunction with the post to provide an augmented, taller display of the figurine. Enabling the base bottom to be rotated 180 degrees means the owner has the option of the logo on the base bottom to be visible from the front of the figurine stand or to not be visible because it has been re-located to the back of the base through rotation of the base bottom and base top relative to one another. The base bottom is provisioned with pin slots, which are channels through the side wall of the base bottom that are proximate to the snap-together feature of the base top. The pin slots are sized such that a user may insert the pin of a figurine through the pin slot and press against the snap-together component of the base top, then lifting the base top away from the base bottom while the snap-together components of the base top and base bottom are separated by the pressure from the inserted pin. The figurine therefore doubles as an adjustment tool for the base of the packaging, the base itself being a supplemental display stand for the figurine.

These and other features and benefits of the wearable ornament implements are described. The foregoing is only a summary and thus contains, by necessity, simplifications, generalizations and omissions of detail. Consequently, those skilled in the art will appreciate that the summary is illustrative only and is not intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

Specific details of certain embodiments of the invention are set forth in the following description and in the figures to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
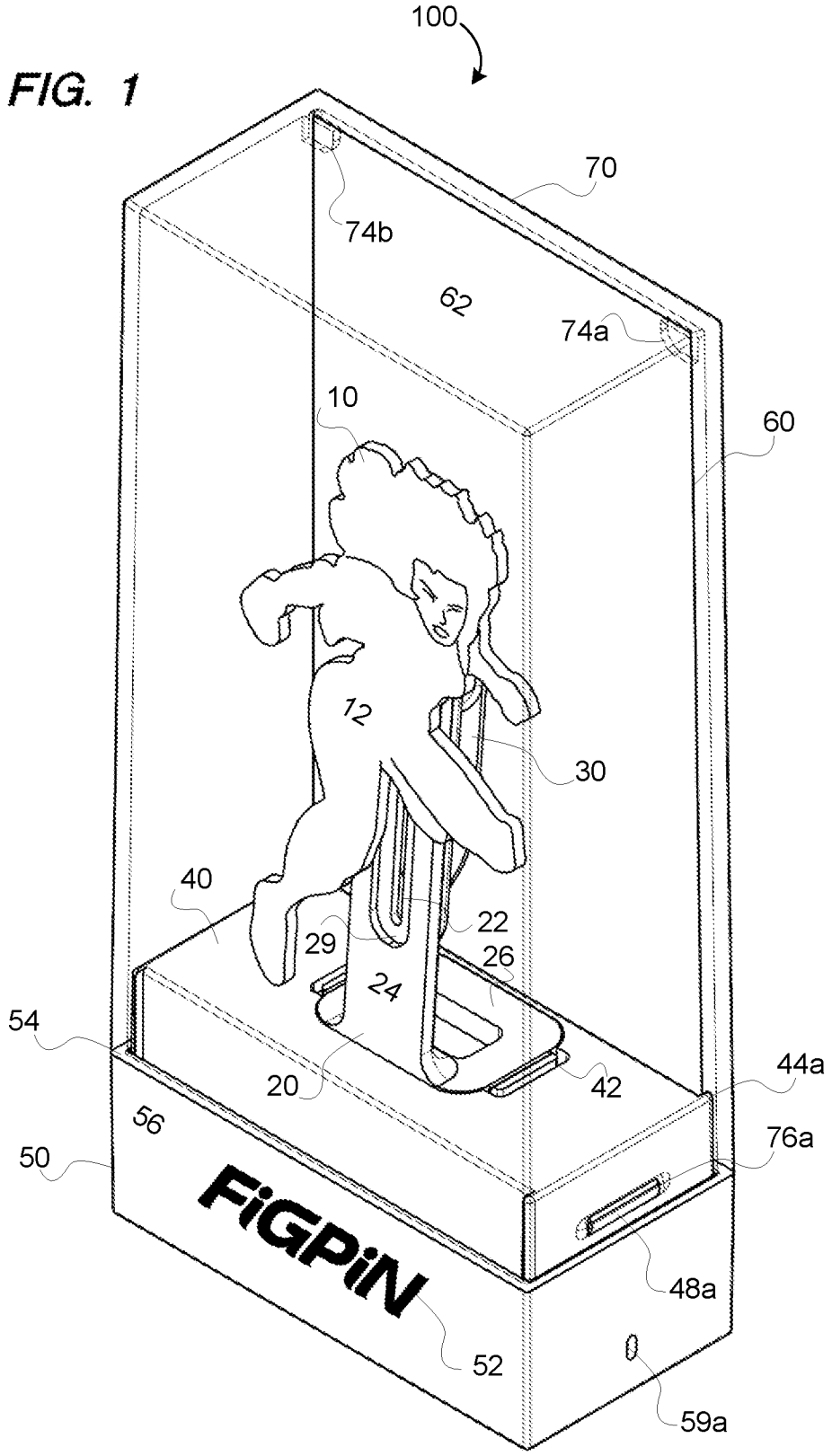
FIG. 1 is a front perspective assembled view of a figurine packaging system.
Figure 2:
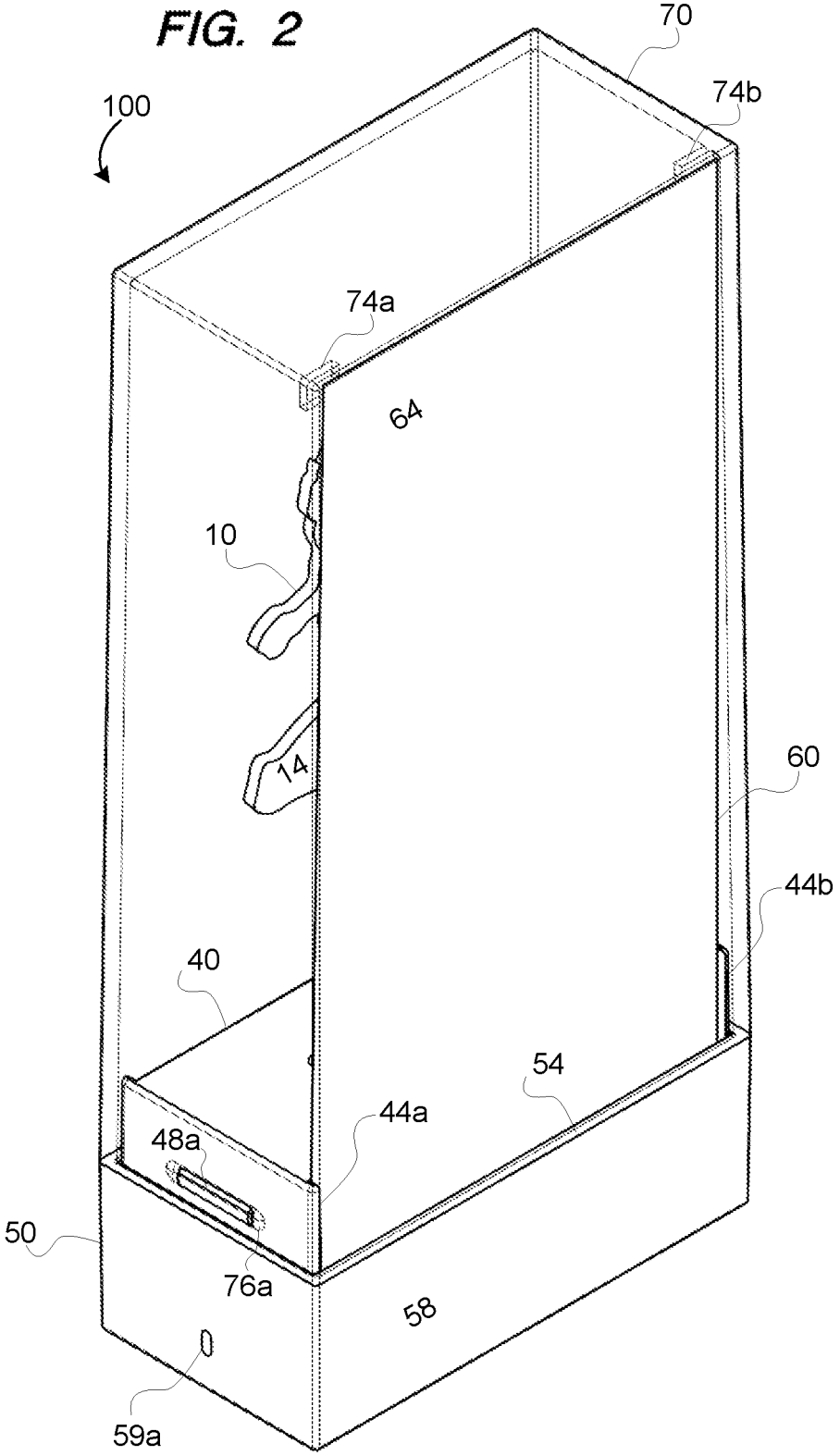
FIG. 2 is a rear perspective assembled view of a figurine packaging system.
Figure 3:
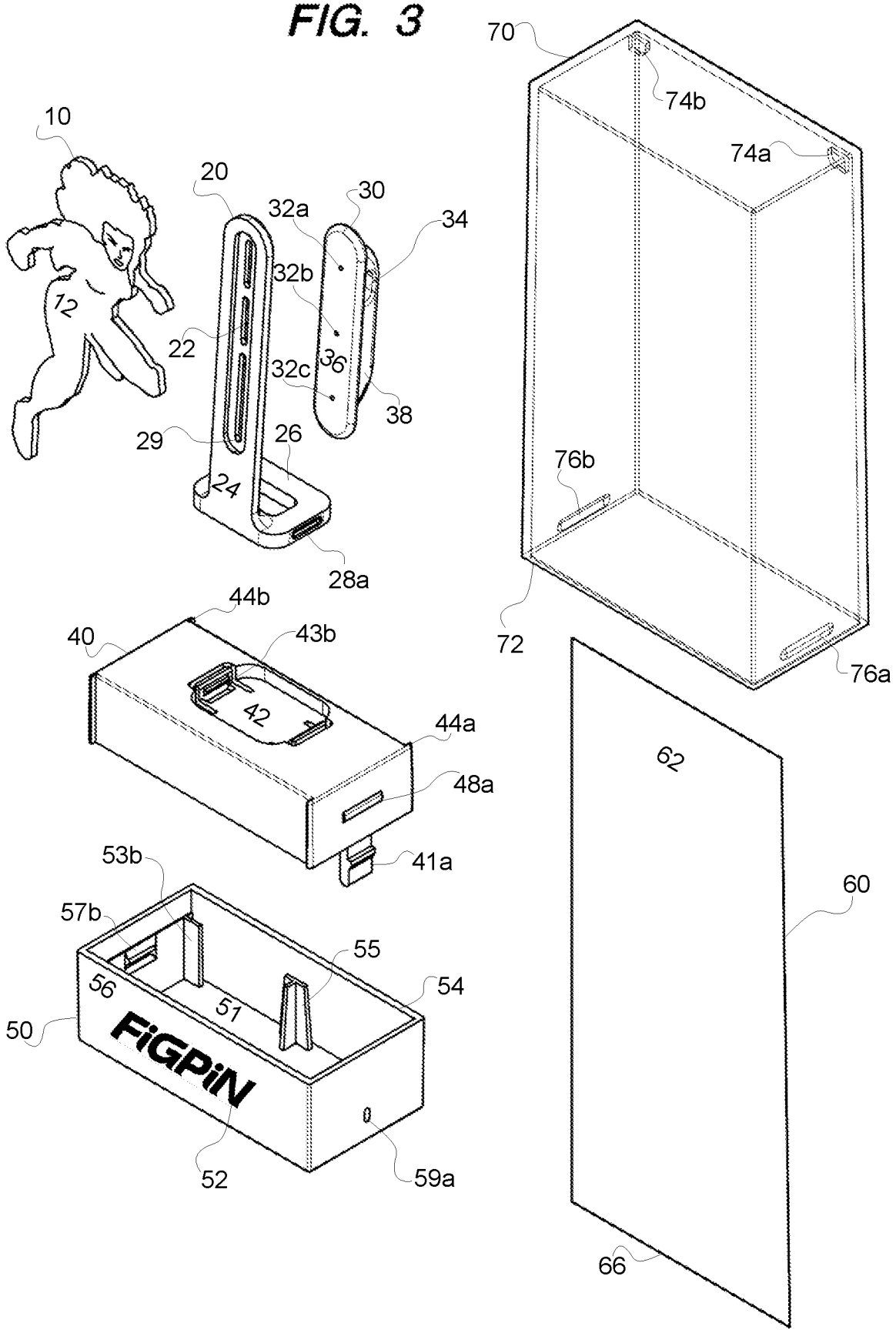
FIG. 3 is a front perspective exploded view of a figurine packaging system.
Figure 4:
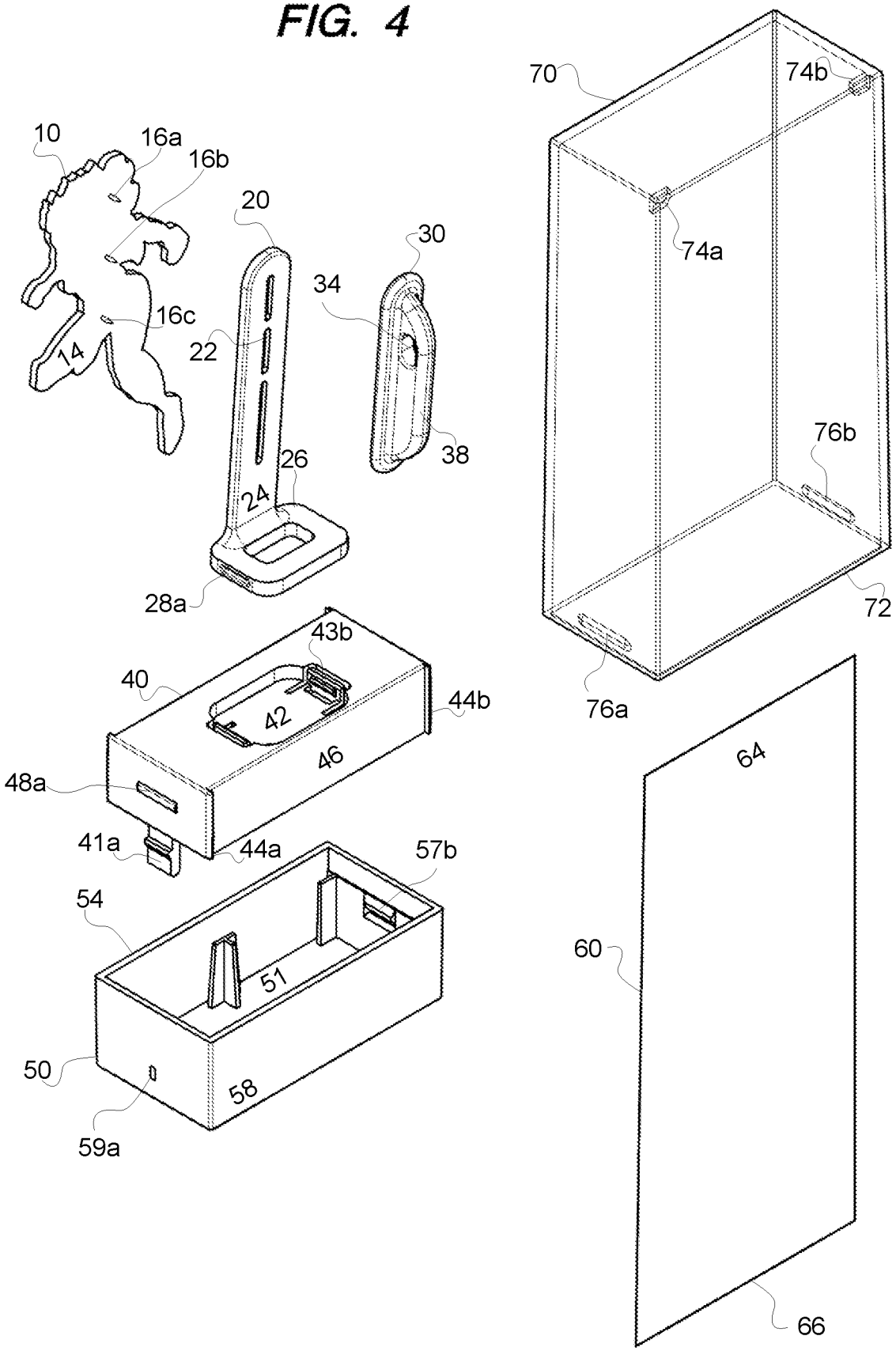
FIG. 4 is a rear perspective exploded view of a figurine packaging system.

FIGS. 1-4 include a front perspective assembled view, a rear perspective assembled view, a front perspective exploded view, and a rear perspective exploded view of a figurine packaging system 100. Figurine 10 includes a front face 12 and a rear face 14. Extending from the rear face of the figurine are three pins, depicted in FIG. 4 as 16*a*, 16*b*, and 16*c*. (Where a reference number herein is used with an alphabetical suffix, e.g. 16*a*, 16*b*, and 16*c*, it is intended to denote multiple instances of the feature being referenced.) The shafts of the pins extend away from the rear face of the figurine. The axis along which the shaft extends may be orthogonal to the rear face of the figurine, although it is not necessary that the pins are orthogonal to the rear face of the figurine. (However, if the pins are not orthogonal, the angle at which pin receptacles in the pin backer disclosed below must be angled relative to the front face of the pin backer accordingly.) The pins terminate in a point, the point being sharp enough to pierce fabric or other materials such as the cork of a corkboard. While the figurine depicted herein includes three pins, any number of pins may be present. When only one pin is used, the figurine, when coupled with the pin backer, may swivel relative to the pin backer about an axis defined by the shaft of the pin. Two or more pins will prevent the figurine from swiveling relative to the pin backer. The front face of the figurine will generally have a decorative design which may include a depiction of an action hero or other artwork.

When packaged and/or when displayed, the pins of the figurine may be passed through pin channels 22 of the upright section 24 of post 20. The pins may then be inserted into pin receptacles 32 of the loop backer 30 (depicted in FIG. 3 as receptacles 32*a*, 32*b*, and 32*c*). The spacing of the pins corresponds to the spacing of the receptacles such that the alignment of the pins and receptacles facilitates inserting each pin of the figurine into its corresponding receptacle of the pin backer. It is noted, however, that the pin channels of the post through which the pins pass are larger than the circumference of the pins, and extend along the vertical axis of the post. Accordingly, figurines with pins spaced differently that the spacing of the exemplary figurine shown herein, or even figurines having a different number of pins, may also be displayed on the post. All that is necessary is for the spacing and number of the receptacles of the pin backer to be able to accommodate the spacing of the pins on the back face of the figurine. The receptacles are sized for tensionally retaining the pins of the figurine. The receptacles may be tapered, for example, whereby the diameter of the receptacle narrows as the receptacle runs from the aperture through the front face 36 of the pin backer towards the handle 38 of the pin backer. The loop backer has a channel 34 through the handle 38. An owner of the figurine may pass a rope or chain or other tie through the channel through the handle in order to wear the figurine as a necklace, or couple it with a backpack.

The post can vary in height, depending on the size of the figurine it will display. The number of pin channels through the post through which the pins pass may also vary. See, for example, the tall post and the short post disclosed in U.S. Design patent application Ser. Nos. 29/736,366 and 29/736,369, both of which having been incorporated by reference herein. A cutout 29 is present in the front face of the upright section of the post, with the pin channels disposed through the cutout. The cutout may alter a weight or balance of the post, enabling it to better support the weight of the figurine without tipping. The upright may be perpendicular to the foot, or may be angled backwards so that the figurine lays back slightly when coupled with the post. The foot 26 of the post rests upon a surface on which the figurine is displayed using the post.

The figurine is pressed against the loop backer, with the post sandwiched between the figurine and loop backer, with enough pressure for the loop backer to frictionally retain the pins of the figurine and therefore maintain the arrangement of the three pieces during shipping (i.e. prevent the figurine from being separated from the post and/or loop backer if the package is shaken or impacted during shipment).

The post is snapped into the post recess 42 of base top 40. Particularly, the foot of the post features dimples on either side. Dimple 28*a* is shown on the right side of the foot of the post. Another dimple is present on the left side of the foot of the post. (Several features discussed herein are present on both the right and left sides of the disclosed packaging system elements. Where the same feature is present on both the right and left sides, the feature on the right side, viewed from the front, uses an alphabetical suffix of "a". The feature on the left side uses an alphabetical suffix of "b". For example, backing retention tabs 74*a* and 74*b* are referenced in this manner and are visible in all of FIGS. 1 through 4. Not all features have both the right and left side instances depicted because the features may be on the opposite side of the structure to which the features are attached and may be invisible in the drawings. For example, while dimple 28*a* on the right side of the foot of the post is visible, the dimple on the left side is not visible because it is on the opposing side. Nevertheless, a dimple is present on the left side of the foot of the post, essentially a mirror-image of the dimple on the right side, and would be understood to be referenced as 28*b* if depicted.)

The dimples have a similar, elongated oval appearance to other features of the stand such as the cutout. A viewer would therefore not notice their presence, or would assume that the dimples are present for aesthetic consistency with the cutout, for example. However, when the post is inserted into the base top, the dimples are engaged by snap locks (e.g. snap lock 43*b*, which would mate with the dimple on the left side of the foot of the post). The base top has a recess 42 in a top face of the base top, the recess sized to receive the foot of the post. When the foot of the post is nestled into the recess, the wall of the foot is continuously in contact with the wall of the recess.

The snap lock is an L shaped lever with a tab extending laterally into the recess. The plastic material of the base top allows the snap lock to be laterally displaced (the snap lock bending in a downward direction) when the foot of the post is pressed into the recess, until the tab of the snap lock can fit into the dimple of the foot. While the post can be pressed into the base top in a plumb direction so that both snap locks engage their corresponding dimples simultaneously, the snap-in feature will also work if the user inserts one side of the post first, engaging the dimple of the foot of the post on that side with the corresponding snap lock. Then the other side of the post down is pressed into the recess, displacing the snap lock on the opposite side of the base top until it snaps into place with its tab inside the opposing dimple. In other words, the post is snappably removable from the base top.

The base top snaps into base bottom 50, with the base top and base bottom being oriented such that logo 52, which is only present on the front face 56 of the base top, is facing outward (i.e. in the same direction that the front face of the figurine would be pointed). The base top rests inside the base bottom atop support posts that extend upward from the floor 51 of the base bottom. There are six such support posts, including two middle posts 55 proximate to the front and rear of the base bottom, and four side posts 53 proximate to the corners of the base bottom. It is noted that a gap is present between the posts and the front and back walls of the base bottom; as will be discussed more fully below, the gap enables backing 60 to be held in place inside the base bottom, the bottom edge 66 of the backing resting on the floor of the base bottom.

The snap-in feature which engages the base top with the base bottom is provided by the engagement of snap locks (e.g. snap lock 41*a*) which descend from the bottom of the base top with corresponding dimples (e.g. dimple 57*b*) in the base bottom. The right-side snap lock of the base top would engage into a dimple in the inside right wall in the base bottom. (The dimple in the inside right wall in the base bottom is not visible in the figures; however, it is a mirror image of the dimple 57*b* which is present in the left wall of the base bottom.) Similar to the manner in which the snap locks between the base top and the foot of the stand operate, the snap locks between the base top and the base bottom also deflect inward when the base top is pressed into the base bottom until a lateral tab across the snap lock engages with the lateral dimple of the base bottom.

It may be that the owner of the figurine wants to utilize the base provided in the packaging as a supplemental display stand. The owner may or may not wish to have the logo on the front of the base bottom be visible. It is noted that the recess in the base top is disposed off-center, proximate to the rear face of the base top, such that merely rotating the post 180 degrees within the base top to move the logo facing the rear would render the display having the recess towards the front of the arrangement, rather than proximate to the rear as intended. Separating the base top and base bottom, however, enables the user to merely rotate the base bottom 180 degrees so that the logo faces backwards and is unable to be seen when the figurine is displayed. Accordingly, pin slots (e.g. pin slot 59*a*) are provided on the right side and left side of the base bottom. The pin slot is a channel into which a pin of the figurine can be inserted, with the point coming to rest on the bottom snap lock of the base top. If the holder presses the figurine inward, the bottom snap lock will deflect inward as well (i.e. towards the inside of the base top), releasing the snap lock from the dimple inside the base bottom. The base top can then be separated from the base bottom. Either the base top or base bottom may be rotated 180 degrees, and then the base top may be pressed into the base bottom again, achieving the objective of rotating the logo to the opposite side of the arrangement. Accordingly, the base bottom removably receives the base top.

Once the figurine is coupled with the post and loop backer, with the post having been snapped into the base top and the base top and base bottom being coupled, assembly may be completed for shipment or retail display by adding the backing 60 and transparent cover 70 to the arrangement. The backing is placed against the rear face 46 of the base top, between the backing alignment ridges 44*a* and 44*b* that extend vertically on either side of the rear face. The backing is sized to fit between the backing alignment ridges. The bottom edge of the backing is then inserted into a gap between the base top and the base bottom, coming to rest along the floor of the base bottom. When inserted into the aforementioned gap, the backing is held up against the back wall of the base bottom by the three posts proximate to the back wall (i.e. the side posts and the T-shaped middle post). The backing may present product information about the particular figurine, may display a UPC code or other symbol, or have other information common to retail packaging. The backing may have artwork printed on front face 62 which complements the visual appearance of the figurine, with the product information on rear face 64.

Then, the five-sided transparent cover 70 is placed over the base top, with its bottom edge 72 also alighting upon the top edge 54 of the base bottom. An upper portion of the backing is disposed between two backing retention tabs 74 near the corners of the inside of the transparent cover, causing, in conjunction with the alignment ridges of the base top and in conjunction with the posts of the base bottom extending from its floor, the backing to be retained within the packaging securely, so that it will not move even if the packaging is shaken during transport. The transparent cover clips onto the base top through the engagement of tabs (such as right side tab 48*a*) which are disposed horizontally along the right and left sides of the base top. The tabs mate with two recesses, 76*a* and 76*b*, which are molded into the transparent cover on its inside, and specifically on the left and right inside walls of the transparent cover near the lower aperture of the transparent cover. The location of the recesses permits the tabs to snap into place inside the recesses of the transparent cover, locking it in place so that it does not rock back and forth or slide during shipment or other movement of the packaging. As the interior walls of the transparent cover are in contact with the exterior walls of the base top when the transparent cover slides over the base top, the transparent cover is said to slidably enclose at least the base top (as well as the post, figurine, and loop backer, if these are coupled with the base top).

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A system, comprising:

a figurine, the figurine including at least two pins;

a backer, the backer including at least two pin receptacles spaced for removably receiving the at least two pins of the figurine;

a post, the post including at least one pin channel, the at least one pin channel capable of permitting the at least two pins to pass;

a base top, the base top including at least:

a recess configured for removably receiving a foot of the post;

a first alignment ridge; and a second alignment ridge;

a base bottom, the base bottom configured for removably receiving the base top;

a transparent cover, the transparent cover configured for slidably enclosing at least the base top; and a backing, the backing configured to fit adjacent to a back face of the base top and within the transparent cover, wherein the first alignment ridge and the second alignment ridge of the base top are spaced to permit the backing to rest in between the first alignment ridge and the second alignment ridge of the base top.

2. The system of claim 1, wherein the base bottom includes at least two side posts and at least a middle post positioned proximate to a rear wall of the base bottom, wherein the backing rests on a floor of the base bottom, the backing positioned between the at least two side posts, the middle post, and the rear wall of the base bottom.

3. The system of claim 1, wherein the post is snappably removable from the base top.

4. The system of claim 1, wherein the base top includes at least a base top recess configured for snappably removably receiving a foot portion of the post.

5. The system of claim 1, wherein the transparent cover includes at least two backing retention tabs.

6. The system of claim 1, wherein the transparent cover clips onto the base top through the engagement of at least two tabs disposed horizontally along the right and left sides of the base top.

7. The system of claim 6, wherein the at least two tabs mate with at least two recesses molded into at least two inside faces of the transparent cover.

8. A system, comprising:

a figurine, the figurine including at least two pins;

a backer, the backer including at least two pin receptacles spaced for removably receiving the at least two pins of the figurine;

a post, the post including at least:

at least one pin channel, the at least one pin channel capable of permitting the at least two pins to pass; and a foot portion, the foot portion including at least a first dimple on a first side of the foot portion and a second dimple on a second side of the foot portion, the second side of the foot portion opposite to the first side of the foot portion; and a base top, the base top including a base top recess configured for snappably removably receiving the foot portion of the post.

9. The system of claim 8, wherein the base top recess includes at least a first tab on a first side of the base top recess and a second tab on a second side of the recess facing the first side of the base top recess.

10. The system of claim 9, wherein a position of the first dimple on the first side of the foot portion of the post corresponds to a position of the first tab on a first side of the base top recess, and wherein a position of the second dimple on the second side of the foot portion of the post corresponds to a position of the second tab on the second side of the base top recess.

11. The system of claim 10, wherein a relative position of the first dimple, the first tab, the second dimple, and the second tab facilitate the base top recess snappably removably receiving the foot portion of the post.

12. The system of claim 8, wherein the base top recess configured for snappably removably receiving the foot portion of the post includes at least a snap lock.

13. A system, comprising:

a figurine, the figurine including at least two pins;

a backer, the backer including at least two pin receptacles spaced for removably receiving the at least two pins of the figurine;

a post, the post including at least:

at least one pin channel, the at least one pin channel capable of permitting the at least two pins to pass; and at least one cutout, the at least one pin channel located within the at least one cutout; and a base top, the base top including a recess configured for removably receiving a foot of the post.

14. The system of claim 13, wherein the backer includes at least a loop backer.

15. The system of claim 14, wherein the loop backer includes at least a channel through a handle of the loop backer.

16. The system of claim 15, wherein the channel through the handle of the loop backer is an oval channel.

17. The system of claim 13, wherein the at least two pin receptacles of the backer are sized for tensionally retaining the at least two pins of the figurine.

18. The system of claim 13, wherein the at least two pins of the figurine are passed through the at least one pin channel of the post and inserted into the at least two pin receptacles of the backer.

19. The system of claim 13, wherein the post includes at least an upright, the at least one pin channel disposed within the upright.

20. The system of claim 13, wherein the backer includes at least a pin backer.

* * * * *